US005343954A

United States Patent [19]

Bohlen et al.

[11] Patent Number: 5,343,954

[45] Date of Patent: Sep. 6, 1994

[54] APPARATUS AND METHOD OF ANCHORING AND RELEASING FROM A PACKER

[75] Inventors: J. Tad Bohlen, Duncan; Donald R. Smith, Wilson; Kevin T. Berscheidt, Duncan, all of Okla.

[73] Assignee: Halliburton Company, Duncan, Okla.

[21] Appl. No.: 971,185

[22] Filed: Nov. 3, 1992

[51] Int. Cl.[5] ..... E21B 23/00

[52] U.S. Cl. ..... 166/382; 166/124; 166/181; 166/237

[58] Field of Search ..... 166/382, 124, 123, 217, 166/181, 237

[56] References Cited

U.S. PATENT DOCUMENTS

| | | | |
|---|---|---|---|
| 3,633,670 | 1/1972 | Brown et al. | 166/125 |
| 4,060,131 | 11/1977 | Kenneday et al. | 166/315 |
| 4,153,109 | 5/1979 | Szescila | 166/123 X |
| 4,305,465 | 12/1981 | Ellis | 166/382 |
| 4,363,358 | 12/1982 | Ellis | 166/212 |
| 4,391,326 | 7/1983 | Greenlee | 166/240 |
| 4,513,822 | 4/1985 | Gilbert | 166/382 |
| 4,646,842 | 3/1987 | Arnold et al. | 166/382 |
| 4,655,290 | 4/1987 | Smith, Jr. | 166/382 |
| 4,660,637 | 4/1987 | McGill et al. | 166/120 |
| 4,726,425 | 2/1988 | Smith, Jr. | 166/387 |
| 4,862,957 | 9/1989 | Scranton | 166/51 |
| 5,074,361 | 12/1991 | Brisco et al. | 166/301 |
| 5,207,274 | 5/1993 | Streich et al. | 166/382 |

*Primary Examiner*—Hoang C. Dang

*Attorney, Agent, or Firm*—Robert A. Kent; Neal R. Kennedy

[57] ABSTRACT

An apparatus and method of anchoring a work string to a packer set in a wellbore and releasing therefrom. The apparatus includes a stinger, a collet slidably disposed on the stinger and having a plurality of collet fingers adapted for engaging the packer, a shear ring member shearably attached to the stringer and adapted for holding the collet fingers into engagement with the packer. The packer may be normally released by applying torque to the work string such that the collet fingers are unthreaded from the packer. Torque is applied from the stinger to the collet fingers by a load ring attached to the stinger and having splines extending between the collet fingers so that torque may be applied to the collet without applying torque to the shear ring member. In the event that rotation is not possible, tension applied to the work string and the stinger will cause the shear ring member to be shearably released from the stinger so that the collet fingers may be pulled longitudinally and thereby disengaged from the packer. A method of use of the apparatus is also disclosed.

17 Claims, 5 Drawing Sheets

APPARATUS AND METHOD OF ANCHORING AND RELEASING FROM A PACKER

BACKGROUND OF THE INVENTION

1. Field of the Invention

The invention relates to downhole tools used in oil and gas wellbores. More particularly, but not by way of limitation, the invention relates to downhole apparatus used anchoring a work string to a packer as well as for releasing the anchoring device from the packer.

2. Description of the Prior Art

In the past, packers such as the Halliburton Drillable-Test-Treat and Squeeze Packers have been utilized in a number of different applications in the oil and gas industry. Other packers, such as that disclosed in U.S. Pat. No. 4,151,875 to Sullaway, assigned to the assignee of the present invention, also contain similar features to the Drillable-Test-Treat and Squeeze Packers.

Before beginning test, treat or squeeze operations, the operator is required to sting into the top of the packer with the workstring. This is also referred to as anchoring into the packer. After the cycle, the anchoring apparatus is pulled out of the wellbore.

Next, it necessary to retrieve the packer from the wellbore. Basically, there are two methods utilized. The first method utilizes the step of drilling the packer out with a rock bit. With this particular method, the packer is literally drilled out of the wellbore. The second method comprises milling over a portion of the packer and utilizing an overshot to pick-out the packer.

The present invention allows for anchoring a stinger assembly to the packer and subsequently retrieving the stinger assembly. A common problem encountered while releasing from the packer is for the stinger assembly to become stuck. Once the stinger assembly becomes stuck, many times the only way of retrieving the work string is to part the work string at some point above the stinger, thus leaving a portion of the work string above the packer in the wellbore. This situation, as will be appreciated by those skilled in the art, presents major difficulties.

U.S. Pat. No. 5,207,274, assigned to the assignee of the present invention, provides a tool that will easily and effectively anchor a stinger assembly to a downhole packer during drill, test, treat or squeeze operations. The tool provides for an emergency release in the event the anchoring tool becomes stuck in the packer. This is accomplished with a stinger with a collet thereon having collet fingers which ratchet into threads in the packer. Upon applying tension to the work string, a shear ring is moved up and under the collet fingers to sufficiently support them so that they will stay locked in the packer. Upon completion of the job, rotation of the work string causes the collet fingers to rotate out of the mandrel and free the stinger from the packer. If the collets freeze up or otherwise become locked in the threads, a predetermined amount of tension on the work string will shearably release the shear ring, thereby removing support from the collet fingers. When the shear ring support is removed, the collet fingers will simply pop out of the packer due to the design of the threads.

During normal operation of this prior apparatus, torque is transmitted to the collet fingers by a splined extension on the shear ring. Because the shear ring is shearably attached, it will provide torque limitation by releasing when sufficient torque is applied thereto. A potential problem is that sufficient torque may be applied prematurely to the splined extensions such that the shear ring is inadvertently sheared, thereby causing premature disengagement of the stinger from the packer.

The present invention solves this problem by modifying the previous apparatus such that the splines are relocated to a separate load or spline ring rather than on the shear ring. In this way, any torque load may be applied without danger of premature releasing of the shear ring.

SUMMARY OF THE INVENTION

The present invention includes both an apparatus and method for anchoring to a downhole device, such as a packer, and having an emergency release in the event the anchoring apparatus becomes stuck while releasing from the downhole device.

The apparatus of the present invention comprises a stinger adapted for insertion into the downhole device, thread mating means for threadingly engaging the stinger with threads in the downhole device, engaging means for engaging the mating means such that the mating means is held in engagement with the threads in the downhole device, and means for transmitting torque from the stinger to the mating means without transmitting torque to the engaging means. The apparatus may further comprise releasing means for releasing the engaging means from engagement with the mating means such that the mating means may be disengaged from the threads in the downhole device without rotation.

In a preferred embodiment, the engaging means is characterized by a ring member disposed on the stinger, and the releasing means comprises shearably attaching the ring member to the stinger. The releasing means is adapted for shearing in response to a predetermined tension applied to the stinger. The releasing means may be characterized by a shear pin disposed through an aperture defined in the ring member and extending into an aperature defined on the stinger.

The mating means is preferably characterized by a collet slidably disposed on the stinger and having a plurality of collet fingers thereon. The collet defines a threaded surface on the collet fingers which is adapted for engagement with the threads in the downhole device. The threaded surface on the collet fingers and the threads in the downhole device may be left-hand threads.

The ring member is adapted for engaging an end of the collet fingers and holding the collet fingers in engagement with the threads in the downhole device. In the illustrated embodiment, the end of the collet has an inner angled end, and the ring member has a chamfered shoulder thereon adapted for engaging the inner angled end.

The means for transmitting torque is characterized by a load ring attached to the stinger and having a spline extending therefrom between adjacent collet fingers such that rotation of the stinger and lock ring results in rotation of the collet. Preferably, the load ring is threadingly engaged with the stinger. The load ring has an upper end adapted for engaging the collet after a predetermined tensile load has been applied to the stinger.

The present invention also includes a method of anchoring a work string to a downhole device, such as a packer, set in a wellbore and subsequently releasing the work string from the downhole device. The method comprises the steps of stinging an anchoring apparatus into the packer, engaging collet fingers on the anchoring apparatus with a threaded surface in the packer, holding the collet fingers in engagement with the threads in the packer by engaging an engaging means with the collet fingers, and rotating the work string such that torque is applied to the collet fingers without applying torque to the engaging means. The method may further comprise the step of applying tension to the work string for releasing the engaging means such that the collet fingers may be disengaged from the threads in the packer without rotation.

Numerous other objects and advantages of the invention will become apparent as the following detailed description is read in conjunction with the drawings which illustrate such embodiment.

DESCRIPTION OF THE PREFERRED EMBODIMENT

Figure 1:
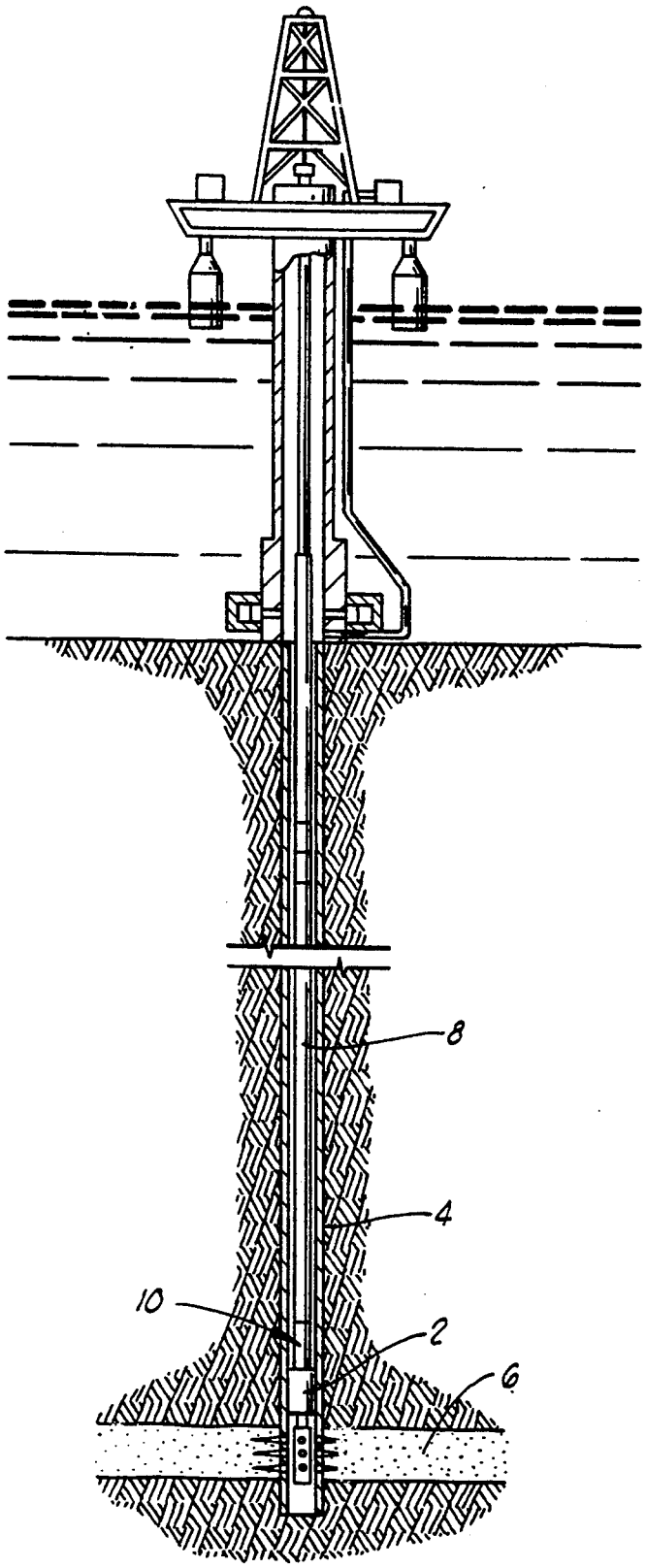
FIG. 1 schematically shows a typical oil and gas derrick with a work string including the apparatus of the present invention for anchoring and releasing from a downhole device. The work string is shown suspended in a well bore that penetrates a hydrocarbon zone.

In oil and gas operations, many times an operator finds it desirable to isolate a particular hydrocarbon bearing zone that is penetrated by casing string. The purpose of isolating may be to test, treat or squeeze the particular hydrocarbon zone. In order to isolate the zones, a downhole device, such as a packer, is utilized in the wellbore, as shown in FIG. 1. One of the variety of packers which may be employed is the Drillable-Test-Treat and Squeeze Packer (DTTS) which may be purchased from Halliburton, the assignee of the present invention. Another packer which may be employed is the EZ Disposable Packer disclosed in U.S. Pat. No. 4,151,875 to Sullaway, and also assigned to Halliburton.

Referring now to the drawings, and more particularly to FIG. 1, one such packer 2 is illustrated in a wellbore 4 adjacent to zone 6. The general purpose of packer 2 is to isolate the particular zone 6 from wellbore 4. Packer 2 may contain a valve of a kind known in the art, and through various manipulations of the work string and/or pressure increases therein, the various desired test, treat and squeeze functions may be carried out, as will be clear to those skilled in the art.

Before beginning a test, treat or squeeze operation, it is necessary to anchor a work string 8 to packer 2. In order to anchor work string 8 to packer 2, the anchoring apparatus of the present invention, generally designated by the numeral 10, is connected to the lower end of work string 8 and anchors to packer 2 as further described herein. After a test, treat or squeeze operation, anchoring apparatus 10 is released from packer 2 and is pulled out of wellbore 4 while packer 2 remains seated in the wellbore.

Once the function of packer 2 has been completed (e.g., testing, treating and/or squeezing), the packer must be removed from the wellbore. Generally, this is accomplished by drilling or milling through the packer, thus the name "drillable, test, treat and squeeze". Drilling techniques employed may vary as previously noted in this application. Many times, the operator will mill over packer 2 to effectively remove it. Also, a mill and overshot can be utilized, which allows for milling over a section of packer 2, and then grabbing, or picking-up, the packer with the overshot.

Figure 2A:
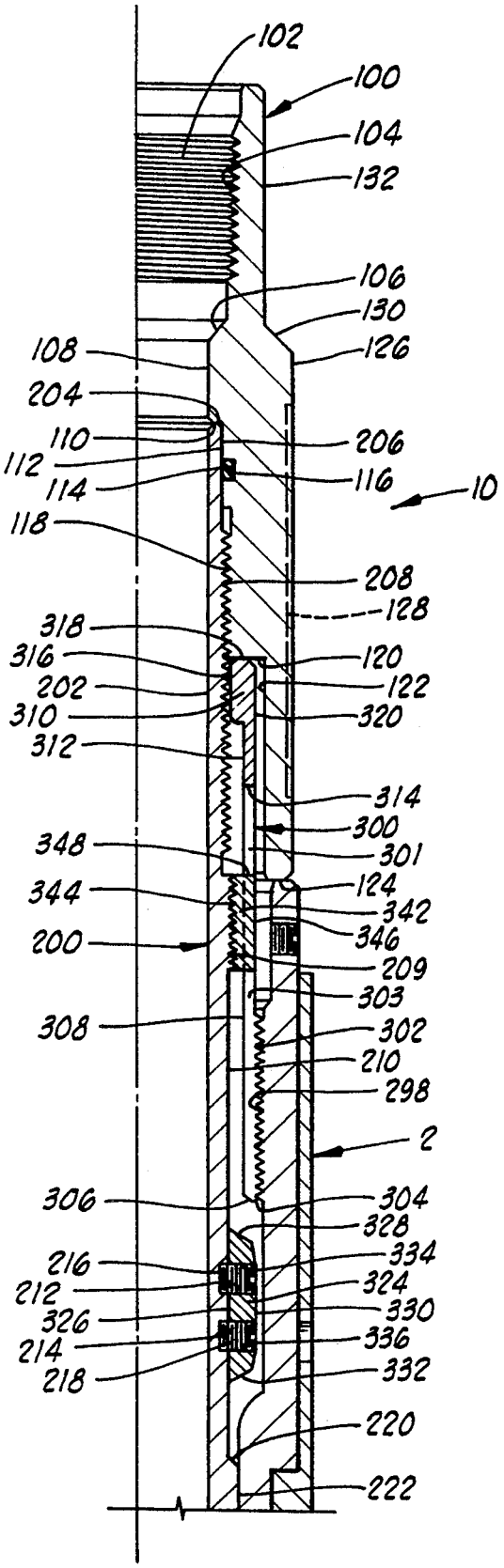
FIGS. 2A and 2B illustrate the apparatus of the present invention in position as the apparatus is stung into the top of a packer.
Figure 2B:
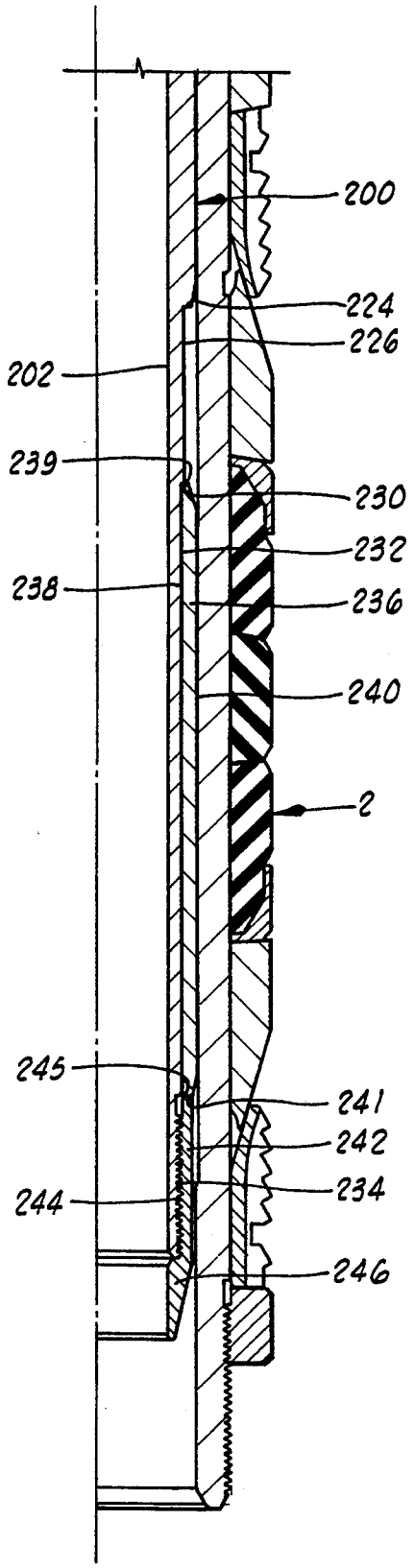

Referring now to FIGS. 2A and 2B, the details of anchoring apparatus 10 will be discussed. Anchoring apparatus 10 comprises a top adapter sub 100 which is also referred to as power mandrel 100. Top adapter sub 100 defines a central opening 102 therethrough. Central opening 102 has a first inner surface with threads 104 thereon for threadingly receiving a portion of work string 8. Central opening 102 also has a second surface defining a chamfered surface 106 and a third surface which is a bore 108.

A radially flat shoulder 110 extends inwardly to a fourth inner surface which is a sealing bore 112 defining a recessed portion 114 adapted for receiving an elastomeric sealing member 116.

Below sealing bore 112 is a portion of top adapter sub 100 which defines internal threads 118 below which is a radially flat shoulder 120. Shoulder 120 extends to a fifth inner surface 122 having a shoulder 124 at the lower end thereof.

Top adapter sub 100 has a first outer surface 126 having a plurality of wrenching flats 128 defined thereon. Extending upwardly and inwardly from first outer surface 126 is a chamfer 130 which leads to a second outer surface 132.

Extending downwardly from top adapter sub 100 is an elongated stinger 200 defining an inner bored surface 202 therethrough. An upper end 204 of stinger is positioned to abut shoulder 110 in top adapter sub 100.

A first sealing surface 206 is defined on the outside of stinger 200 and is adapted for sealing engagement with sealing member 116. Below first sealing surface 206 is an outer surface having external threads 208 thereon which are threadingly mated with internal threads 118 of top adapter sub 100.

Below external threads 208 the outer surface of stinger 200 defines additional external threads 209. External threads 209 are illustrated to be slightly larger than external threads 200, but the invention is not intended to be limited to this particular relationship between the external threads.

Below external threads 209 stinger 200 has a second outer surface 210. A pair of apertures or grooves 212 and 214 are defined in outer surface 210, and these apertures are adapted for receiving the ends of shear pins 216 and 218, respectively, as will be further described herein.

The outside of stinger 200 further defines a tapered shoulder 220 which extends between second outer surface 210 and a third outer surface 222. Referring now to FIG. 2B, at the lower end of third outer surface 222 is a second tapered surface 224. Extending below second tapered surface 224 is a fourth outer surface 226.

A radially flat shoulder 230 extends between fourth outer surface 226 and a fifth outer surface 232. Below fifth outer surface 232 is another outer surface having an external thread means 234 thereon.

A stinger fitting 236 defines an internal bore 238 therein which surrounds fifth outer surface 232 of stinger 200. An upper end 239 of stinger fitting 236 abuts shoulder 230 on stinger 200. Stinger fitting 236 has an outer surface 240 with a lower end 241 therebelow.

An end cap 242 is positioned at the lower end of stinger 200 and has internal threads 244 which are threadingly mated with external threads 234 on the stinger. An upper end 245 of end cap 242 abuts lower end 241 on stinger fitting 236. The lower end of end cap 242 forms a cap shoe portion 246.

Figure 5:
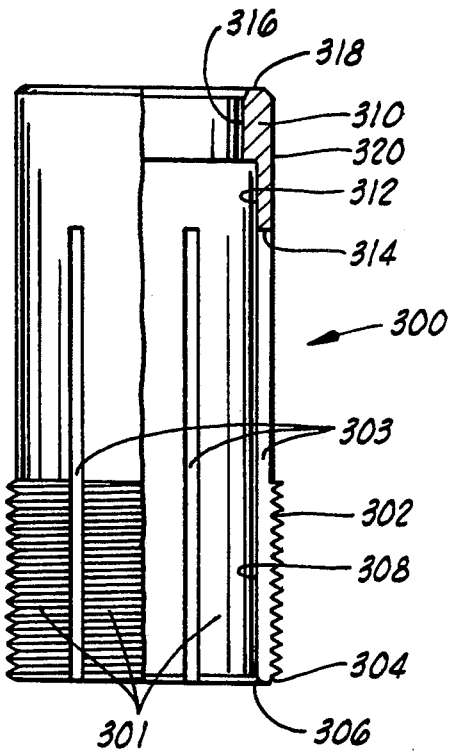
FIG. 5 illustrates a partial longitudinal cross section and elevation of a threaded collet used in the apparatus.

The anchoring apparatus of the present invention also comprises thread mating means for threadingly mating stinger 200 into the top of a downhole device, such as packer 2. That is, apparatus 10 is adapted for engaging, for example, internal left-hand threads 298 in packer 2. Referring now to FIGS. 2A and 5, this mating means is characterized by a collet 300 having a plurality of spaced collet fingers or members 301. Collet fingers 301 define a plurality of gaps or slots 303 therebetween.

Defined on the lower end of collet 300 are external left-hand threads 302. It will be seen that a portion of external threads 302 is formed on the lower end of each collet finger 301. In the preferred embodiment, the thread design of external threads 302 is a front angle thread. However, other thread designs may be utilized, including a back angle thread. External threads 302 are adapted to be complementary to the design of internally threaded surface 298 in packer 2, so that external threads 302 may be mated together with internal threads 298.

At the bottom of each collet finger 301 is a first or outer angled end 304 and a second or inner angled end 306. The plurality of collet fingers 301 define a bore 308 therein.

The upper ends of collet fingers 301 on collet 300 terminate at housing member 310 which has an internal surface 312 defined therein. Housing member 310 has a plurality of shoulders 314 thereon which form the upper end of each slot 303.

Housing member 310 defines a bore 316 therethrough which is disposed above, and is preferably smaller than, internal surface 312. Bore 316 is adapted to be slidable along threads 208 on stinger 200 and opens at upper end 318 of housing member 310. Upper end 318 of housing member 310 abuts shoulder 120 in top adapter sub 100 when collet 300 is in the position shown in FIG. 2A.

Collet 300 has an outer surface 320 which extends from housing member 310 along collet fingers 301 to external threads 302.

Apparatus 10 further comprises an engaging means for engaging the mating means characterized by collet 300. Still referring to FIG. 2A, the engaging means comprises a shear ring member 324 which defines an internal bore 326 therethrough. Bore 326 is adapted to fit closely on second outer surface 210 of stinger 200.

At the upper end of shear ring 324 is an upwardly facing chamfered surface 328. The angle of chamfered surface 328 is complementary to the angle of internal angled end 306 of collet fingers 301. Shear ring 324 has an outer surface 330, and at its lower end, the shear ring has a downwardly facing chamfered surface 332.

Extending radially through shear ring 324 are a plurality of shear pin apertures 334 and 336. Shear pins 214 and 216, previously mentioned, are disposed through apertures 334 and 336, respectively, and into apertures or grooves 212 and 214, respectively, of stinger 200. Thus, shear pins 214 and 216 shearably hold shear ring 324 on stinger 200. Shear pins 216 and 218 may be sheared, as further described herein, thus providing a releasing means for releasing the engaging means characterized by shear ring 324.

A splined load ring 342, also called a spline ring 342, is disposed on stinger 200 above shear ring 324. Load ring 342 has an internal thread 344 adapted for threading engagement with external threads 209 on stinger 200.

Figure 6:
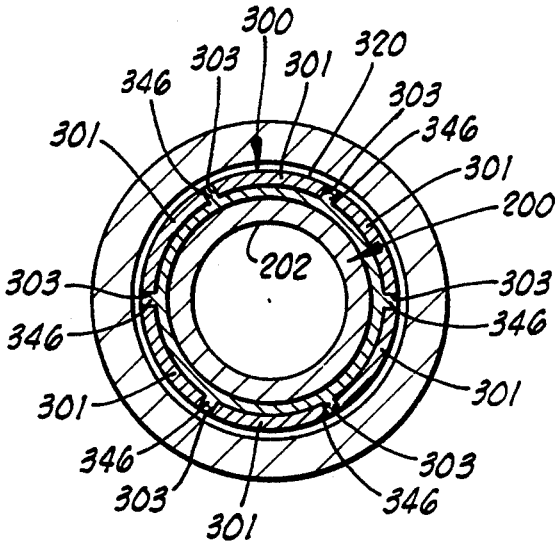
FIG. 6 is a cross section taken along lines 6—6 in FIG. 4A.

Referring now to FIGS. 2A and 6, a plurality of circumferentially spaced splines 346 extend radially outwardly from load ring 342. Each spline 346 extends into a corresponding slot 303 defined between adjacent pairs of collet fingers 301 on collet 300. Each spline 346 has an upper end 348.

OPERATION OF THE INVENTION

Referring to FIG. 1 and FIGS. 2A and 2B, work string 8 is lowered into the wellbore with anchoring apparatus 10 attached to the lower end thereof. Cap shoe 246 of end cap 242 attached to the lower end of stinger 200 acts as a guide as stinger 200 enters packer 2. Anchoring apparatus 10 is lowered into packer 2 so that it is in the position shown in FIGS. 2A and 2B. Weight is set down so that, as external threads 302 on the lower end of collet 300 engage internal threads 298 in packer 2, collet fingers 301 deflect inwardly so that collet 300 may be lowered into the position shown in FIG. 2A. When downward movement of anchoring apparatus 10 is stopped, it will be seen by those skilled in the art that external threads 302 on collet 300 will be engaged with internal threads 298 in packer 2. In this position, the desired operations, such as a test, treat or squeeze operation, may be carried out in a manner known in the art.

After the operation is completed, anchoring apparatus 10 may be released from packer 2 as follows. Work string 8 is picked up. In other words, tension is applied to work string 8. When this occurs, top adapter 100 and stinger 200 are raised with respect to packer 2. Because bore 316 in housing member 310 of collet 300 is free to slide along external threads 208 on stinger 200, the stinger will slide upwardly within collet 300 to the position shown in FIGS. 3A and 3B. That is, stinger 200 is raised until chamfered surface 328 on shear ring 324 engages internal angled end 306 at the lower end of collet fingers 301. In this way, collet fingers 301 are prevented from flexing inwardly so that external threads 302 will remain engaged with internal threads 298 in packer 2.

Work string 8 is then rotated to the right (clockwise). Because splined load ring 342 is locked onto stinger 200, the load ring will rotate as work string 8, including top adapter 100 and stinger 200, is rotated. The engagement of splines 346 in slots 303 between collet fingers 301 insures that torque will be transmitted from stinger 200 through load ring 342 to collet fingers 301 of collet 300. In other words, as stinger 200 is rotated, collet 300 will be rotated with it. Because external threads 302 on collet 300 and internal threads 298 in packer 2 are left-hand threads, the right-hand rotation will unscrew collet 300 from the packer, thereby releasing anchoring apparatus 10 from the packer. At this point, work string 8 and anchoring apparatus 10 may be raised out of wellbore 4.

Well debris may settle in the top of packer 2 such that rotation of work string 8 is no longer possible. That is, debris may lock collet 300 with respect to packer 2. In previous anchoring devices, it was necessary to cut the tubing above the stinger and leave the stinger engaged with the packer in the wellbore. This cutting operation is not necessary with the apparatus of the present invention.

Figure 3A:
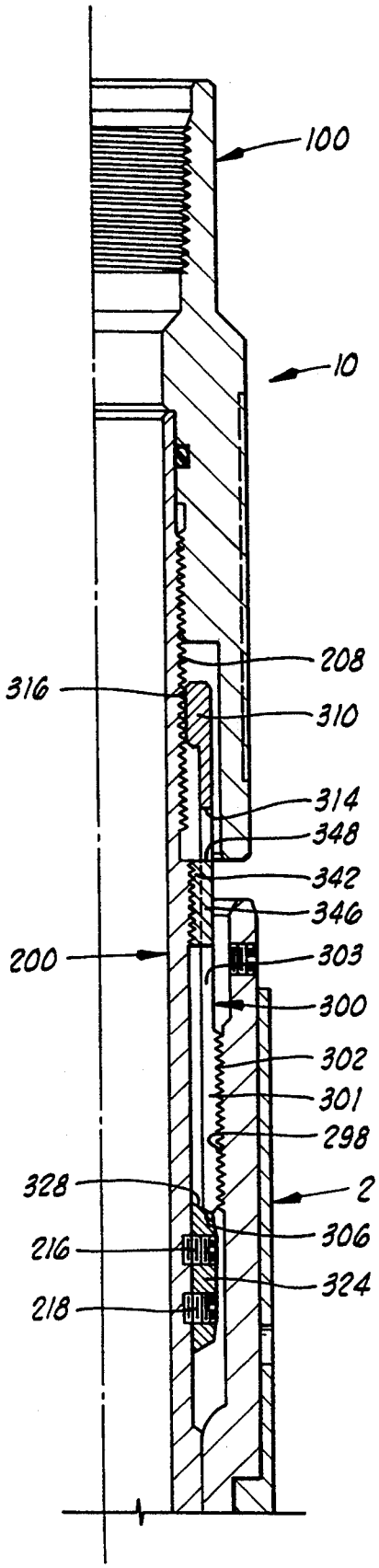
FIGS. 3A and 3B show the apparatus under a tensile load and still connected to the packer.
Figure 3B:
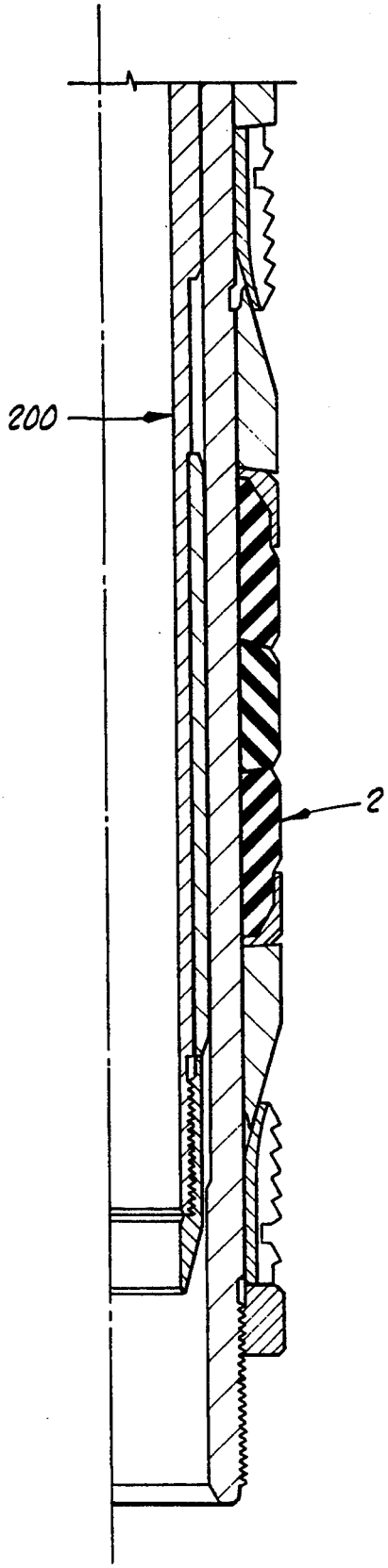
Figure 4A:
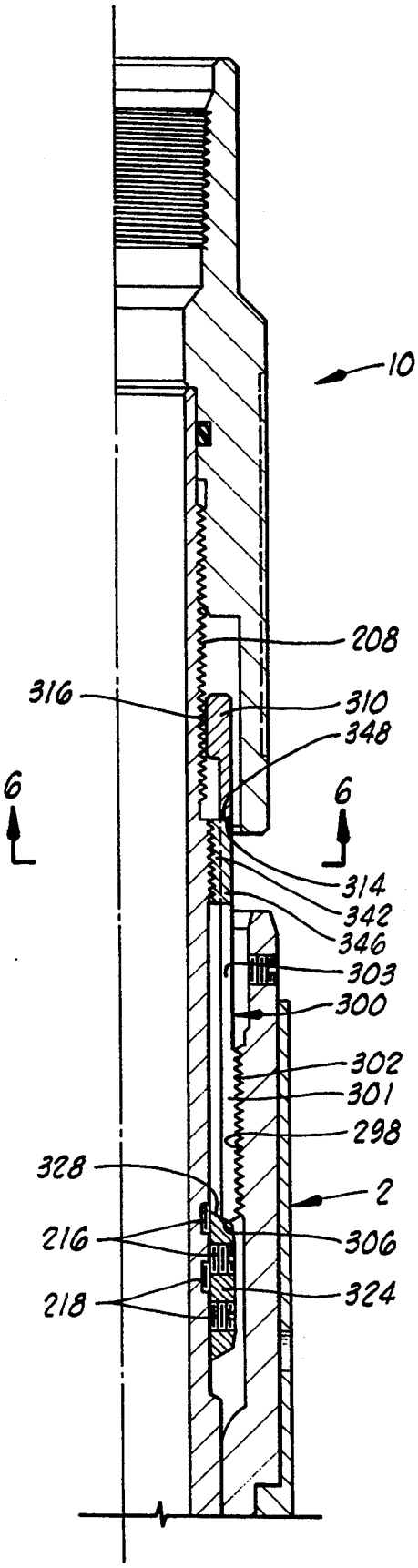
FIGS. 4A and 4B in an emergency release position in which the shear pins holding the shear member have been sheared such that the tensile load is placed on a splined load ring.
Figure 4B:
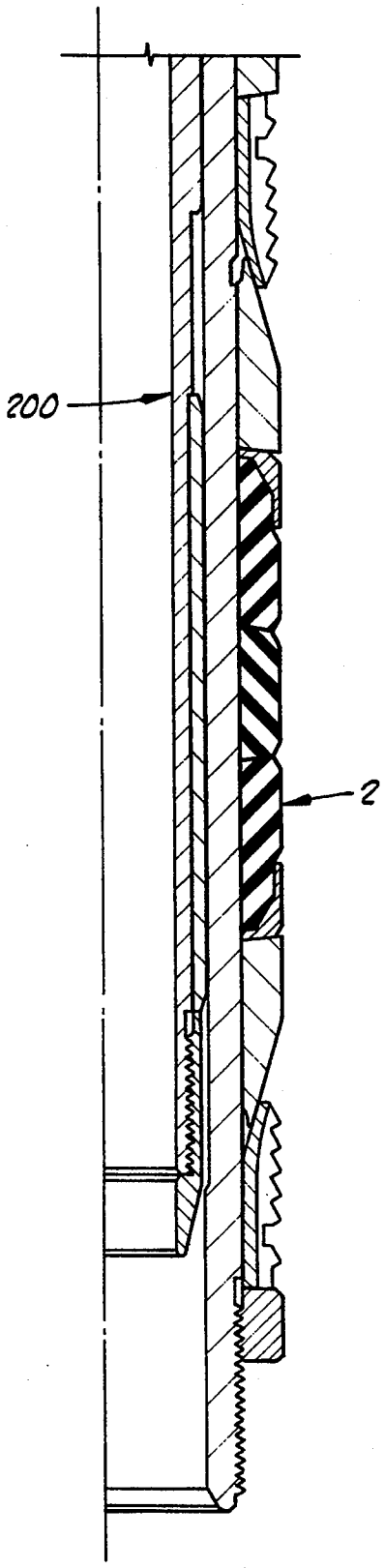

If rotation of work string 8 is no longer possible, the operator may apply additional tension to the work string, and this tension is transmitted to stinger 200 of anchoring apparatus 10. Referring to FIG. 3A, it will be seen that tension on stinger 200 results in shear ring 324 being pulled against inner angled end 306 of collet 300. Referring now to FIGS. 4A and 4B, when predetermined tension has been applied, shear pins 216 and 218 will shear, thus allowing stinger 200 to move upwardly within shear ring 324. Further pull on work string 8 will result in stinger 200 and load ring 342 moving longitudinally upwardly. Upper ends 348 of splines 346 on load ring 342 will engage shoulders 314 on housing member 310 of collet 300. Because shear ring 324 has been shifted longitudinally downwardly with respect to stinger 200, collet fingers 301 of collet 300 are free to retract or deflect inwardly so that external threads 302 thereon are no longer engaged with internal threads 298 in packer 2.

It will be seen by those skilled in the art that further pulling on work string 8 will result in anchoring apparatus 10 being removed from packer 2. That is, since collet 300 is no longer engaged with packer 2, stinger 200 may be pulled upwardly and out of packer 2.

Thus, it is apparent that the apparatus of the present invention readily achieves the advantages mentioned as well as those inherent therein. While certain preferred embodiments of the invention have been illustrated for the purpose of this disclosure, numerous changes in the arrangement and construction of parts may be made by those skilled in the art, which changes are embodied within the scope and spirit of the present invention are defined by the appended claims.

What is claimed is:

1. An apparatus for anchoring to and releasing from a downhole device of the type having threads in the upper end thereof, said apparatus comprising:

a stinger adapted for insertion into the downhole device;

thread mating means for threadingly engaging said stinger with the threads in said downhole device;

engaging means for engaging said thread mating means such that said thread mating means is held in engagement with said threads in said downhole device, said engaging means being characterized by a ring member disposed around said stinger;

means for transmitting torque from said stinger to said mating means without transmitting torque to said engaging means; and releasing means for releasing said engaging means from engagement with said thread mating means such that said thread mating means may be disengaged from said threads in said downhole device without rotation, said releasing means comprising means for shearably attaching said ring member to said stinger and being adapted for shearing in response to a predetermined tension applied to said stinger.

2. The apparatus of claim 1 wherein:

said mating means is characterized by a collet having a plurality of collet fingers thereon and defining a threaded surface on said collet fingers adapted for engagement with said threads in said downhole device; and said ring member is adapted for engaging an end of said collet fingers and holding said collet fingers in engagement with said threads in said downhole device.

3. The apparatus of claim 2 wherein:

said end of said collet has an inner angled end; and said ring member has a chamfered shoulder thereon adapted for engaging said inner angled end.

4. The apparatus of claim 1 wherein said releasing means is characterized by a shear pin disposed through an aperture defined in said ring member and extending into an aperture defined on said stinger.

5. The apparatus of claim 1 wherein said thread mating means is characterized by a collet having a plurality of collet fingers adapted for engagement with said thread in said downhole device.

6. The apparatus of claim 5 wherein said means for transmitting torque is characterized by a load ring attached to said stinger and having a spline extending therefrom between adjacent collet fingers such that rotation of said stinger and lock ring results in rotation of said collet.

7. The apparatus of claim 6 wherein said load ring is threadingly engaged with said stinger.

8. An apparatus for anchoring to and releasing from a downhole device of the type having threads in the upper end thereof, said apparatus comprising:

a stinger adapted for insertion into the downhole device;

a collet slidably disposed on said stinger and having a plurality of collet fingers, said collet defining threads thereon adapted for engaging the threads in said downhole device;

a shear ring shearably attached to said stinger and adapted for engaging an end of said collet fingers such that said threads on said collet are held in engagement with said threads in said downhole device; and a splined load ring attached to said stinger and having splines extending therefrom between said collet fingers such that torque applied to said stinger is transmitted to said collet.

9. The apparatus of claim 8 wherein:

said collet has an angled end; and said shear ring has a chamfered surface thereon adapted for engaging said angled end.

10. The apparatus of claim 8 wherein said load ring is threadingly attached to said stinger.

11. The apparatus of claim 8 wherein said torque is transmitted from said stinger to said collet without transmitting torque to said shear ring.

12. An apparatus for anchoring to and releasing from a downhole device of the type having threads in the upper end thereof, said apparatus comprising:

a stinger adapted for insertion into the downhole device;

a collet slidably disposed on said stinger and having a plurality of collet fingers, said collet defining threads thereon adapted for engaging the threads in said downhole device;

a shear ring attached to said stinger and adapted for engaging an end of said collet fingers such that said threads on said collet are held in engagement with said threads in said downhole device; and a splined load ring attached to said stinger and having splines extending therefrom between said collet fingers such that torque applied to said stinger is transmitted to said collet, and said load ring having an upper end adapted for engaging said collet after a predetermined tension has been applied to said stinger.

13. The apparatus of claim 12 wherein said upper end of said load ring is formed on said splines.

14. A method of anchoring a work string to a packer set in a wellbore and releasing the work string from the packer, said method comprising the steps of:

stinging an anchoring apparatus into the packer;

engaging collet fingers on said anchoring apparatus with a threaded surface in the packer;

holding said collet fingers in engagement with said threads in said packer by engaging an engaging means with said collet fingers;

rotating the work string such that torque is applied to said collet fingers without applying torque to said engaging means; and applying tension to the work string for releasing said engaging means such that said collet fingers may be disengaged from said threads in said packer.

15. An apparatus for anchoring to and releasing from a downhole device of the type having threads in the upper end thereof, said apparatus comprising:

a stinger adapted for insertion into the downhole device;

thread mating means for threadingly engaging said stinger with the threads in said downhole device, said thread mating means being characterized by a collet having a plurality of collet fingers adapted for engagement with said thread in said downhole device;

engaging means for engaging said thread mating means such that said thread mating means is held in engagement with said threads in said downhole device; and means for transmitting torque from said stinger to said mating means without transmitting torque to said engaging means, said means for transmitting torque being characterized by a load ring threadingly engaged with said stinger and having a spline extending therefrom between adjacent collet fingers such that rotation of said stinger and lock ring results in rotation of said collet, said load ring having an upper end adapted for engaging said collet after a predetermined tensile load has been applied to said stinger.

16. An apparatus for anchoring to and releasing from a downhole device of the type having threads in the upper end thereof, said apparatus comprising:

a stinger adapted for insertion into the downhole device;

a collet slidably disposed on said stinger and having a plurality of collet fingers, said collet defining threads thereon adapted for engaging the threads in said downhole device;

a shear ring shearably attached to said stinger and adapted for engaging an end of said collet fingers such that said threads on said collet are held in engagement with said threads in said downhole device, said shear ring being releasable in response to a predetermined tension applied to said stinger; and a splined load ring attached to said stinger and having splines extending therefrom between said collet fingers such that torque applied to said stinger is transmitted to said collet.

17. An apparatus for anchoring to and releasing from a downhole device of the type having threads in the upper end thereof, said apparatus comprising:

a stinger adapted for insertion into the downhole device;

a collet slidably disposed on said stinger and having a plurality of collet fingers, said collet defining threads thereon adapted for engaging the threads in said downhole device;

a shear ring attached to said stinger by a shear pin and adapted for engaging an end of said collet fingers such that said threads on said collet are held in engagement with said threads in said downhole device; and a splined load ring attached to said stinger and having splines extending therefrom between said collet fingers such that torque applied to said stinger is transmitted to said collet.

* * * * *